US011612238B2

(12) United States Patent
Schaerer et al.

(10) Patent No.: US 11,612,238 B2
(45) Date of Patent: Mar. 28, 2023

(54) LIFTING COLUMN FOR A PIECE OF FURNITURE

(71) Applicant: USM U. Schärer Söhne AG, Münsingen (CH)

(72) Inventors: Alexander Schaerer, Muri b. Bern (CH); Thomas Dienes, Bern (CH); Bastian Roth, Thun (CH)

(73) Assignee: USM U. SCHARER SOHNE AG, Munsingen (CH)

( * ) Notice: Subject to any disclaimer, the term of this patent is extended or adjusted under 35 U.S.C. 154(b) by 0 days.

(21) Appl. No.: 17/495,107

(22) Filed: Oct. 6, 2021

(65) Prior Publication Data

US 2022/0104613 A1 Apr. 7, 2022

(30) Foreign Application Priority Data

Oct. 6, 2020 (EP) ..... 20200316

(51) Int. Cl.
*A47B 9/04* (2006.01)

(52) U.S. Cl.
CPC ..... *A47B 9/04* (2013.01)

(58) Field of Classification Search
CPC ..... A47B 9/04; A47B 9/20
See application file for complete search history.

(56) References Cited

U.S. PATENT DOCUMENTS 5,685,510 A * 11/1997 Frankish ..... A47B 17/02 248/188.4
6,289,825 B1 9/2001 Long
7,658,359 B2 2/2010 Jones et al.
2006/0075941 A1 4/2006 Seidl et al.
2012/0227522 A1 9/2012 Wu
2014/0020488 A1* 1/2014 Koch ..... F16B 21/186 29/525.01
2018/0172062 A1* 6/2018 Hu ..... F16H 25/2056
2018/0184799 A1* 7/2018 Lin ..... H02K 7/06
(Continued)

FOREIGN PATENT DOCUMENTS

DE 2232278 A 2/1973
EP 1230872 A1 8/2002

*Primary Examiner* — Daniel J Rohrhoff
(74) *Attorney, Agent, or Firm* — GableGotwals

(57) ABSTRACT

The present application relates to a lifting column for a piece of furniture, in particular for a table. The lifting column comprises a first element and also a second element. The second element is introduced at least some way into the first element. The first element has a spindle, which extends along the longitudinal axis of the first element and projects at least some way into the second element. The second element has a rotor, which is mounted in a rotatable manner in it and has at least one rolling body, which runs in or on a thread helix of the spindle. A rotation of the rotor relative to the spindle gives rise to a linear movement of the second element relative to the first element. The second element also has an arresting device, which, in a first state, blocks the rotation of the rotor relative to the spindle and, in a second state, frees the rotation of the rotor relative to the spindle. At least one leg spring is clamped in between the rotor and a fastening element, which is fastened on the second element, and this leg spring therefore subjects the rotor to a prestressing force.

15 Claims, 5 Drawing Sheets

(56) References Cited

U.S. PATENT DOCUMENTS

| | | | | |
|---|---|---|---|---|
| 2021/0215180 | A1* | 7/2021 | Robier | F16B 7/14 |
| 2021/0321760 | A1* | 10/2021 | Windhaber | A47B 9/20 |
| 2022/0039548 | A1* | 2/2022 | Tseng | A47B 9/04 |
| 2022/0243793 | A1* | 8/2022 | Hu | A47B 9/04 |

* cited by examiner

LIFTING COLUMN FOR A PIECE OF FURNITURE

CROSS-REFERENCE TO RELATED APPLICATIONS

This United States application claims priority to European Patent Application No. 20 200 316.6 filed 6 Oct. 2020, which is incorporated herein by reference.

TECHNICAL FIELD

The present invention relates to a lifting column for a piece of furniture, in particular for a table, the lifting column having compensation for the weight of the piece of furniture. The invention also relates to a piece of furniture, in particular a table, having at least one lifting column having compensation for the weight of the piece of furniture.

PRIOR ART

The prior art discloses different lifting columns and/or height-adjustable legs for pieces of furniture, in particular for tables. The length of the lifting column and/or of the leg can be adjusted by motor or manually. In particular in the case of manual adjustment, it is advantageous if the lifting column and/or the height-adjustable leg has means which make it possible to compensate for the weight of the piece of furniture, in particular the weight of a table top.

U.S. Pat. No. 7,658,359 discloses, for example, devices for table-height adjustment. The table leg comprises a first, outer column element and a second, inner column element, a weight-compensating device, a blocking device and rollers, which are arranged on the inner column element and interact with raceways in the outer column element. The weight-compensating device comprises, inter alia, a spring, a worm wheel for compensating for the variable spring force and also a cable, which interacts with the worm wheel and is fastened on the inner side of the outer column element. The prestressing of a compression spring which acts on the cable mounting can be set by means of a spool which can be actuated by a knob.

DESCRIPTION OF THE INVENTION

The object of the invention is to create a lifting column which belongs to the technical field mentioned in the introduction and is of straightforward construction and has weight compensation.

This object is achieved by means of the features as defined in claim 1. According to the invention, the lifting column comprises a first element and a second element. The second element is introduced at least partially into the first element. The first element comprises a spindle, which extends along the longitudinal axis of the first element and projects at least partially into the second element. The second element comprises a rotor which is mounted in a rotatable manner within said second element and which includes at least one rolling body which runs in or on a thread helix of the spindle. A rotation of the rotor relative to the spindle results in a linear movement of the second element relative to the first element. The second element further includes an arresting device, which, in a first state, blocks the rotation of the rotor relative to the spindle, and, in a second state, frees the rotation of the rotor relative to the spindle. At least one leg spring is clamped in between the rotor and a fastening element which is fastened on the second element, said leg spring subjecting the rotor to a prestressing force.

The prestressing force of the at least one leg spring can at least partially compensate for the weight of a piece of furniture connected to the lifting column. The use of at least one leg spring, in addition, simplifies the construction of the lifting column. Also, the construction of the lifting column according to the invention is very low-maintenance.

A lifting column in the present application is understood to be a device which, on the one hand, can be positioned on an underlying surface, in particular on a floor, and, on the other hand, can be connected to a piece of furniture, it being possible for the length of the device to be altered for the purpose of setting the height of the piece of furniture.

The lifting column according to the invention is used in particular for a table. In this case, the lifting column is preferably connected to a table top. A table preferably comprises one, two or even four lifting columns according to the invention.

The first and the second elements are configured in the form of hollow bodies, wherein the two elements are of the same shape in cross section. In order for the second element to be introduced into the first element, it has cross-sectionally slightly smaller dimensions. The dimensions of the cross section of the first and of the second elements are preferably selected such that, with the second element introduced into the first element, there is a gap of a few millimeters, but in particular a gap of less than 1 cm, between the elements. The second element is introduced concentrically in the first element, that is to say that the longitudinal axis of the first element coincides with the longitudinal axis of the second element.

The first and the second elements are preferably of a round, rectangular or polygonal shape in cross section. The first element and the second element are preferably manufactured from a metal or from a metal alloy, in particular from stainless steel or from aluminum. The two elements are preferably of elongate configuration, that is to say that the length thereof is considerably greater than the cross section thereof. The first element and the second element preferably each have a length of at least 35 cm, in particular of at least 45 cm. The maximum dimension of the two elements in cross section is preferably 3 cm, further preferably 5 cm.

The first element, at a first end thereof preferably has a closed surface area, by means of which the first element can be positioned on an underlying surface, in particular on a floor. The first element is open at the second end, which is located opposite the first end, and therefore a first end of the second element can be introduced into this second end of the first element. At the second end of the second element, this second end being located opposite the first end, the second element preferably has means for fastening the second element to a piece of furniture. These means are preferably configured in the form of holes or slots for screws or bolts.

A length adjustment of the lifting column can be achieved by virtue of the second element being moved into the first element and/or moved out of the first element. This length adjustment makes it possible to set the height of a piece of furniture which is connected to the lifting column. Depending on the length setting of the lifting column, the second element is therefore introduced into the first element over a longer or shorter part of its length.

The spindle is preferably arranged centrally in the first element and extends from the first end to the second end of the first element. The spindle therefore extends along the longitudinal axis of the first element. The spindle can extend along the entire length of the first element, that is to say from the first end to the second end thereof. However, the spindle preferably extends only over part of the length of the first element.

The spindle preferably has a high-helix thread. The term "high-helix thread" in the following application is understood to mean a thread with a pitch (helix height) of at least 10 mm, preferably of at least 20 mm. The spindle preferably has one thread helix. As an alternative, however, it is also possible for the spindle to have more than one thread helix, in particular two thread helixes.

The rotor is preferably mounted in the second element such that it can be rotated via a rolling bearing, and therefore the rotor can rotate relative to the second element. The rotor is oriented such that it can rotate about the longitudinal axis of the second element. The at least one roiling body of the rotor is preferably arranged at an angle which corresponds to the pitch angle of the spindle. The rotor preferably has more than one rolling body, in particular has three rolling bodies, which are arranged in each case at an angle of 120° in relation to one another in the circumferential direction of the rotor.

A rotation of the rotor means that since the at least one rolling body runs in or on the thread helix of the spindle—the rotor will be displaced linearly relative to the spindle. Since the rotor is mounted in a rotatable manner on the second element, a displacement of the rotor relative to the spindle also results in a linear displacement of the second element relative to the first element.

When the arresting device blocks the rotation of the rotor, an unintended length adjustment of the lifting column can be prevented. If the lifting column is fastened on a piece of furniture, the arresting device remains in the first state and is shifted into the second state only when the piece of furniture is to be adjusted in height. For the switchover between the first state and the second state (and back), the arresting device preferably has an actuating element, in particular a lever or a button, which can be actuated by a person.

The length adjustment of the lifting column according to the invention preferably takes place manually. This means that a person adjusts the length by pulling the second element out of the first element or by pushing it into the same. If a piece of furniture is connected to the lifting column, the action of pulling the piece of furniture upwards, or of pushing it downward, can result in a length adjustment of the lifting column and, ultimately, in a height adjustment of the piece of furniture. In the first state, the arresting device blocks the rotation of the rotor and thus also the length adjustment of the lifting column and the height adjustment of a piece of furniture connected to the lifting column.

As an alternative, however, the rotor may be rotated by an electric or electromechanical drive, which allows to achieve an automatic length adjustment of the lifting column and an automatic height adjustment of a piece of furniture connected to the lifting column.

The fastening element is preferably fixed to the second element, that is to say that the fastening element cannot rotate about the longitudinal axis of the second element. A first leg of the at least one leg spring is connected to the fastening element or butts against the same, whereas a second leg is connected in a rotationally fixed manner to the rotor.

A leg spring has two legs, between which a multiplicity of windings of the spring are located. The at least one leg spring is preferably arranged within the second element such that the longitudinal axis of the leg spring coincides with the longitudinal axis of the second element.

The prestressing force of the leg spring subjects the rotor to a torque. This torque rotates the rotor in one direction, provided the rotation of the rotor has been freed by the arresting device. The leg spring here is arranged such that the prestressing force subjects the rotor to a torque which results in the second element moving out of the first element, that is to say in the length of the lifting column increasing. The second element here is subjected to a force oriented in the corresponding direction. When the lifting column is used as intended, the first element is standing on an underlying surface, in particular on a floor, wherein the longitudinal axis of the first element and also of the second element are located perpendicularly to the underlying surface. Accordingly, the longitudinal axes of the first element and of the second element are oriented essentially parallel to the direction of gravity. Accordingly, the force acting on the second element is directed essentially vertically upward. This force therefore counteracts the weight of a piece of furniture connected to the lifting column. This makes it possible to at least partially compensate for the weight of the piece of furniture, which makes it easier in particular for the length of the lifting column to be increased and for the height of the piece of furniture to be increased. An appropriate setting of the prestressing force of the leg spring therefore also makes it possible to compensate fully for the weight of a piece of furniture connected to the lifting column. In this case, even when the arresting device is in the second state, the piece of furniture, without any external action of force, is not adjusted in height since the weight and the force acting on the second element cancel each other out.

The at least one rolling body is preferably configured in the form of a ball, cylindrical roller, tapered roller or barrel roller.

If the at least one rolling body is configured in the form of a ball or in the form of a cylindrical roller, the at least one rolling body runs in a thread helix or engages in the same. If the at least one rolling body is configured in the form of a tapered roller or barrel roller, the at least one rolling body preferably runs on a thread helix of the spindle.

For the purpose of setting the prestressing force of the at least one leg spring, the fastening element can preferably be moved in the form of an arc of a circle around the longitudinal axis of the leg spring.

The circular movement of the fastening element makes it possible to set the leg-spring prestressing force, which corresponds to the spring force. The fastening element here has means which can block the rotation of the fastening element. This makes it possible to maintain a set prestressing force. The means have, in particular, a lever or handle, which can be operated by a person. Furthermore, the second element preferably has setting means, by which the fastening element can be made to move in the form of a circle around the longitudinal axis of the leg spring.

The fastening element is preferably arranged on a worm wheel, which can be made to rotate by means of a worm connected in a rotationally fixed manner to the second element.

This achieves a particularly straightforward embodiment of a fastening element which can be moved in the form of a circle around the longitudinal axis of the leg spring, in addition, the self-locking action which is inherent in the worm gears makes it possible to dispense with additional means for the purpose of blocking the circular movement of the fastening element around the longitudinal axis of the leg spring.

The first element and the second element, preferably have a round cross section, wherein the second element has a smaller diameter than the first element.

The second element is preferably guided in a linearly movable manner within the first element by at least one linear guide. The linear guide may prevent the second element from rotating within the first element. The second element is preferably guided within the first element by more than one linear guide, in particular by way of two, three or four linear guides. The linear guide can be configured, for example, in the form of a pin running in a groove or in the form of a roller guide.

The second element preferably has at least one rolling bearing, wherein an outer ring of the rolling bearing is introduced into a groove of the first element in order to form the at least one linear guide. This allows to provide a linear guide with a very low resistance and which is also space-saving in a straightforward manner.

The rolling bearing used is preferably a ball bearing. As an alternative, however, it is also possible to use a cylindrical-roller bearing or a needle bearing. The second element preferably has a plurality of circumferentially distributed rolling bearings, which are introduced in a corresponding number of grooves in the first element.

In a preferred embodiment, the first element has three rolling bearings, which are arranged in each case at an angle of 120° relative to one another about the longitudinal axis of the second element.

In a further preferred embodiment, two of the three rolling bearings are arranged at an angle of 90° relative to one another, wherein these two rolling bearings are each arranged at an angle of 135° in relation to the third rolling bearing about the longitudinal axis of the second element. In the case of this embodiment, the first element preferably has 8 grooves, which are arranged in each case at an angle of 45° relative to one another about the longitudinal axis of the first element. This allows the second element to be introduced into the first element in 8 different angular positions.

The rotor is preferably connected to a hollow shaft which extends within the second element, coaxially in relation to the same, to a second end of the second element, this second end not being introduced into the first element, wherein the hollow shaft has a toothing formation in the region of the second end of the second element.

In the first state, the arresting device preferably engages in the toothing formation by way of a rack, which is fastened on the second element, or of a gearwheel, which is connected in a rotationally fixed manner to the second element. This means that the rotary shaft, and therefore also the rotor connected thereto, cannot rotate. By virtue of the rack or of the gearwheel being raised, pushed or pivoted away from the toothing formation, it is possible, in the second state, to free the rotation of the hollow shaft and also of the rotor.

Furthermore, the toothing formation can be used to synchronize the length adjustment of a plurality of lifting columns in that the latter are connected by means of at least one shaft which use gearwheels or bevel wheels to engage, in each case, in the toothing formation of the respective lifting columns.

The thread helix of the spindle preferably has a variable pitch. This makes it possible to compensate for the leg-spring force, which differs in dependence on the depth by which the second element is introduced into the first element.

The movement of the second element relative to the first element rotates the rotor about the spindle. This means that, depending on the position of the second element relative to the first element, the helical spring is subjected to stressing to a greater or lesser extent, which results in a variation of the spring force to which the rotor is subjected or in the torque which is caused thereby. Despite this fact, by using a corresponding variation in the pitch of the thread helix the force subjected by the leg spring to the rotor, and therefore to the second element, may be made constant. In regions in which the leg spring is subjected to lesser stressing, and therefore a lower spring force is applied, the pitch of the thread helix is smaller than in regions in which the leg spring has a higher level of stressing and therefore a higher spring force.

The at least one rolling body is preferably a cylindrical roller, tapered roller or barrel roller, which is configured in the form of a rolling bearing in the case of which an outer ring forms the cylindrical roller, tapered roller or barrel roller and runs in or on the thread helix of the spindle. This arrangement makes it possible to achieve a straightforward, low-maintenance configuration of the at least one rolling body, which has a very low rolling resistance in addition.

In the case of this embodiment, the outer ring of the rolling bearing therefore forms the rolling body which runs in or on the thread helix of the spindle. Accordingly, the rolling body designed in the form of a rolling bearing can be connected to the rotor via its inner ring. The outer ring is of a shape which corresponds to the shape of the rolling body.

The rolling bearing used is preferably a ball bearing. As an alternative, however, it is also possible to use a cylindrical-roller bearing or a needle bearing. The outer ring of the rolling bearing preferably has a convexity which runs around it and is complementary to the profile of the thread helix. This results in the at least one rolling body engaging to particularly good effect in the thread helix of the spindle.

A plurality of leg springs, in particular two leg springs, are preferably clamped in in a parallel state between the rotor and fastening element. This means that all of this plurality of leg springs have one leg fastened on the rotor, whereas the other leg butts against the fastening element or is connected thereto.

This arrangement can increase the prestressing force to which the rotor is subjected by the leg springs.

The present invention also relates to a piece of furniture having at least one lifting column described above and also having at least one furniture element which is fastened to the at least one lifting column. The piece of furniture is preferably a table, in which case the furniture element on which the at least one lifting column is fastened is a table top.

The piece of furniture preferably has more than one lifting column, in particular has two or four lifting columns. For example, the piece of furniture can be a height-adjustable desk having two lifting columns, which are fastened on a rectangular table top.

A shaft is preferably fitted on the furniture element, the shaft having a bevel wheel which engages in the toothing formation of the hollow shaft of the at least one lifting column.

This shaft can synchronize the rotation of rotors of a plurality of lifting columns fastened on the furniture element. The shaft preferably has a bevel wheel at both ends, and therefore the shaft can synchronize the rotation of rotors of two lifting columns fastened on the furniture element. If more than two lifting columns are fastened on the furniture element, use is correspondingly also made of a plurality of shafts with two bevel wheels.

The shaft is preferably fitted on the furniture element by means of a holder, wherein the holder has a double wrap spring brake, which acts on the shaft. The double wrap spring brake here acts as an arresting device, since it can block and free the rotation of the hollow shaft, and therefore of the rotor connected thereto. The holder preferably has an actuating element, for example a lever, which can release the braking action to which the shaft is subjected by the double wrap spring brake.

A crankshaft is preferably fitted on the furniture element, it being possible for the crankshaft to drive the worm. This simplifies a height adjustment of the at least one furniture element since this can be achieved by a rotation of the crankshaft.

Further advantageous embodiments and combinations of features of the invention can be gathered from the following detailed description and from the patent claims in their entirety.

BRIEF DESCRIPTION OF THE DRAWINGS in the drawings, which are used for the purpose of explaining the exemplary embodiment:

Figure 4A:
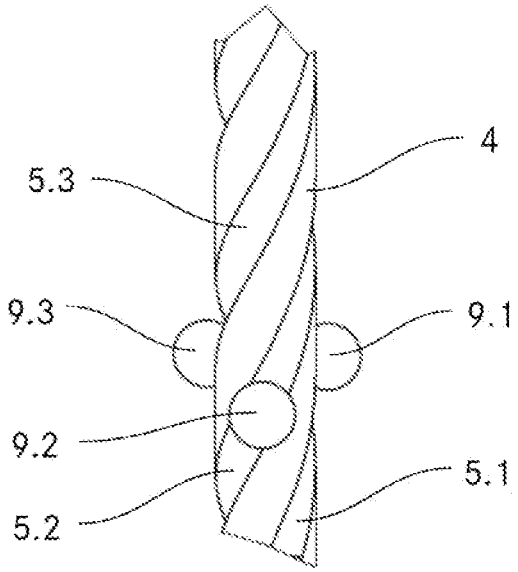
Figure 4B:
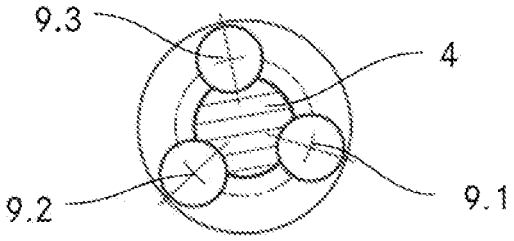
Figure 5A:
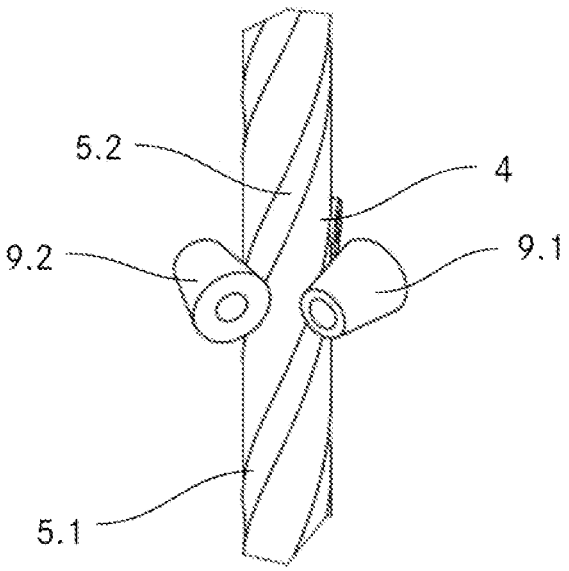
Figure 5B:
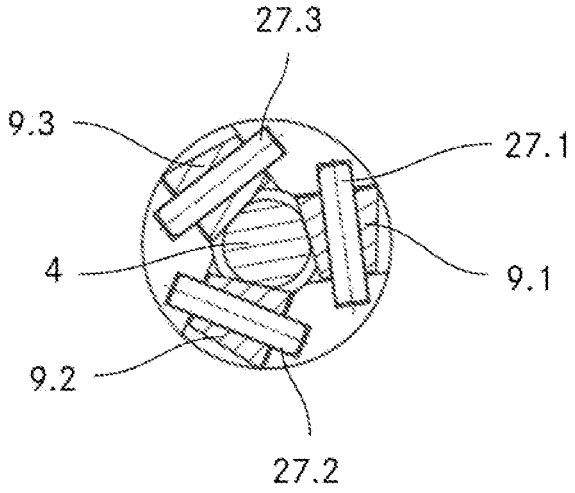

FIGS. 4*a* and 4*b* show detail-specific views of a second embodiment of a lifting column according to the invention, having rolling bodies designed in the form of balls; and FIGS. 5*a* and 5*b* show detail-specific views of a third embodiment of a lifting column according to the invention, having rolling bodies designed in the form of tapered rollers.

In the figures, in principle, like parts are provided with like reference signs.

WAYS OF IMPLEMENTING THE INVENTION

Figure 1:
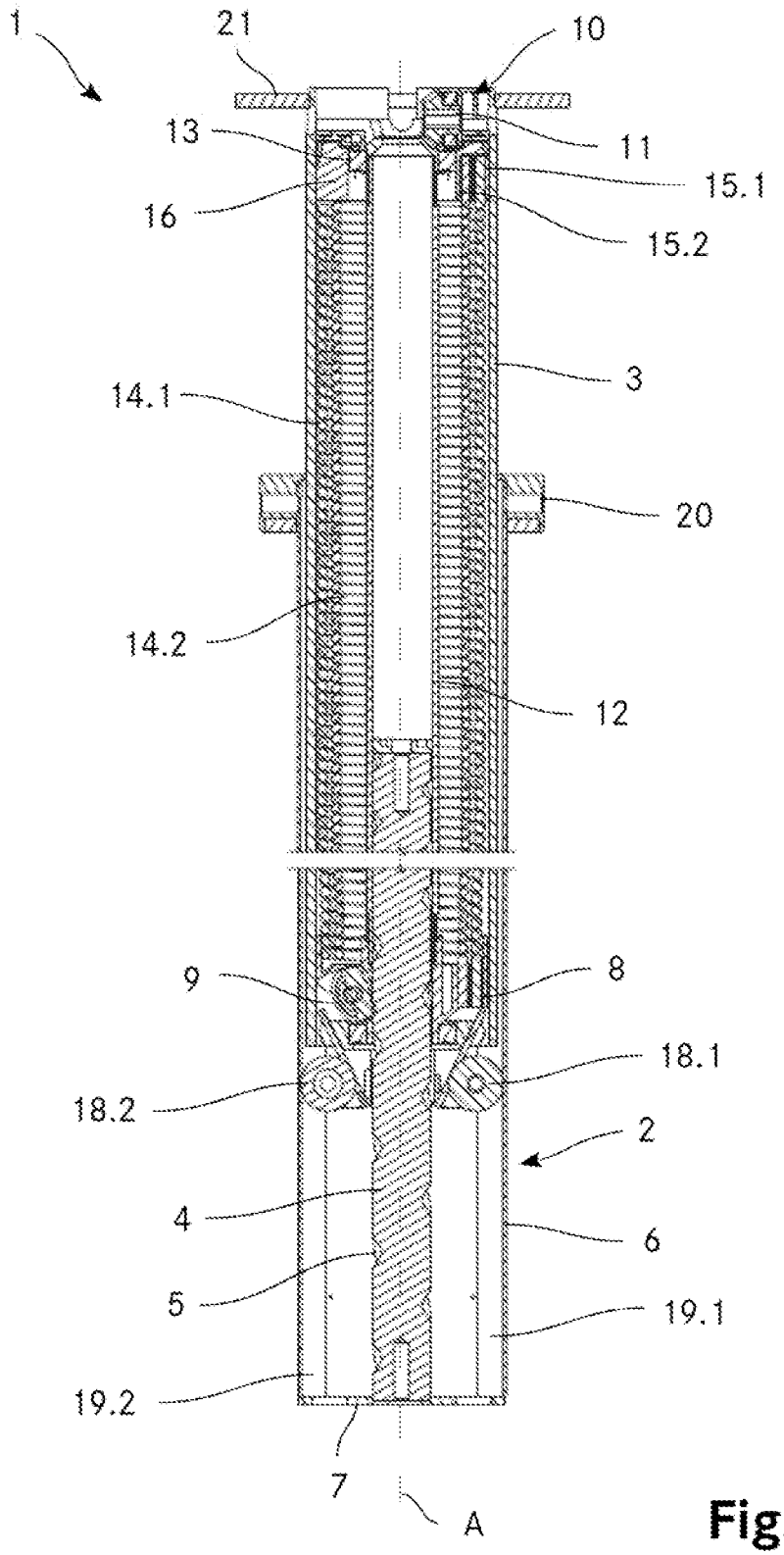
FIG. 1 shows a sectional illustration of one embodiment of a lifting column according to the invention.

FIG. 1 shows a sectional illustration of one embodiment of a lifting column 1 according to the invention. The lifting column 1 comprises a first element 2, which has an encircling first wall 6, which encloses an interior space. A second element 3 with a second encircling wall 7 is introduced at least partially into the first element 2, that is to say into the interior space of the first element 2. A first end of the second element 3 is located within the first element 2, whereas a second end of the second element 3, this second end being located opposite the first end, projects out of the first element.

In the case of the embodiment shown, the two elements 2, 3 have a round cross section, wherein the diameter of the second element 3 is smaller than the diameter of the first element 2. The second element 3 can be displaced linearly in the first element 2. This means that the second element 3 can be moved linearly in the first element along a longitudinal axis A of the first element. The second element 3 has the same longitudinal axis A as the first element 3.

The second element 3 is mounted in a displaceable manner in the first element 2 via linear guides. On that side of the first wall 2 which is directed towards the interior space, the linear guides have grooves 19.1, 19.2, in which a respective outer ring of rolling bearings 18.1, 18.2, which are arranged at a first end of the second element 3, run. In the case of the embodiment shown, the first element has eight grooves 19.1, 19.2, of which FIG. 1 shows just two, which are distributed on the first wall 6 in a state in which they are offset in each case through 45° in relation to one another about the longitudinal axis A. The second element 3 also has three rolling bearings 18.1, 18.2, of which FIG. 1 shows just two. The first rolling bearing 18.1 and the second rolling bearing 18.2 are located at an angle of 135° in relation to one another about the longitudinal axis A, whereas the third rolling bearing (not visible here) is located in each case at an angle of 90° relative to the first rolling bearing 18.1 and to the second rolling bearing 18.2.

The first element 2 also has a closed surface area 24 at its first end. The first element 2 can be positioned on a floor by means of this closed surface area 24. At this closed surface area 24, a spindle 4 is fastened centrally within the first element 2. The spindle 4 extends along the longitudinal axis A of the first element 2, but not all the way to the second end of the first element. This means that the spindle 4 does not project out of the interior space of the first element 2. The spindle 4 has a thread helix 5 of variable pitch. The pitch of the thread helix 5 decreases from the first end of the spindle 4 to the second end thereof.

A rotor 8 is arranged in the region of the first end of the second element 3. The rotor 8 is mounted in a rotatable manner on the second element 3, and this allows the rotor to rotate freely about the longitudinal axis A, although it cannot be displaced relative to the second element 3. The rotor 8 has arranged on it three rolling bodies 9.1 (of which FIG. 1 shows just one), which are designed in the form of cylindrical rollers and engage in the thread helix 5 of the spindle 4. The rolling bodies 9.1 are fitted at an angle relative to the rotor 8, and the rolling bodies can therefore engage in an essentially play-free manner in the thread helix 5. As a result of the rolling bodies 9.1 engaging in the thread helix 5, a rotation of the rotor 8 causes the second element 3 to move linearly relative to the first element 2.

In the region of the second end, the second element 3 has two fastening elements 15.1, 15.2. Two leg springs 14.1, 14.2 are clamped in between the fastening elements 15.1, 15.2 and the rotor 8. The leg springs 14.1, 14.2 are fastened in a rotationally fixed manner to the rotor 8 and also to the respective fastening element 15.1, 15.2. The leg springs 14.1, 14.2 subject the rotor 8 to a prestressing force. This prestressing force subjects the rotor 8 to a torque. The leg springs 14.1, 14.2 here are prestressed such that the torque rotates the rotor 8 in the direction which causes the second element 3 to move out of the first element 2. If the lifting column 1 is standing on a floor, the prestressing force therefore causes the length of the lifting column 1 to increase. The prestressing force, then, can compensate for the weight of a piece of furniture fastened on the lifting column 1. That is to say that the prestressing force is selected such that it corresponds essentially to the weight of the piece of furniture connected to the lifting column 1. This allows a person to set the height of the piece of furniture relatively straightforwardly and without any great amount of force being applied.

Depending on the position of the rotor 8 along the spindle 4, the prestressing force to which the rotor 8 is subjected by the leg springs 14.1, 14.2 differs, since the leg springs 14.1. 14.2 are rotated out of their rest position to a greater or lesser extent by the rotation of the rotor 8. In order for the prestressing force to which the second element 3 is subjected by the rotor 8 to be kept essentially constant in any position of the rotor 8 along the length of the spindle 4, the spindle 4 has the aforementioned variable thread-helix pitch.

A worm wheel 16 is arranged in the region of the second end of the second element 3 and has the fastening elements 15.1, 15.2 connected to it. The worm wheel 16 can be rotated by virtue of a worm 15 (see FIG. 3) being rotated. This rotation makes it possible to vary the prestressing force of the leg springs 14.1, 14.2, since the fastening elements 15.1, 15.2 are rotated at the same time.

The rotor 8 is connected to a hollow shaft 12, which extends, within the windings of the leg springs 14.1, 14.2, in the direction of the second end of the second element 3. The hollow shaft 12 has a toothing formation 13 in the region of the second end of the second element 3. A bevel wheel 11 engages in this toothing formation 13. The bevel wheel 11 and the toothing formation 13 together form an arresting device 10, which, in a first state, blocks the rotation of the rotor 8 relative to the spindle 4 and, in a second state, frees this rotation. In the first state, the rotation of the bevel wheel 11 is blocked and, in the second state, it is freed. This can be achieved by a suitable mechanism being provided. For example, the bevel wheel 11 can be connected to a shaft (not shown) with which a double wrap spring brake interacts.

A fastening element 21 is arranged at the second end of the second element 3, it being possible for this fastening element to be used to fasten the lifting column 1 on a piece of furniture, in particular on a table top. Furthermore, a flange is arranged in the region of the second end of the first element 2.

Figure 2:
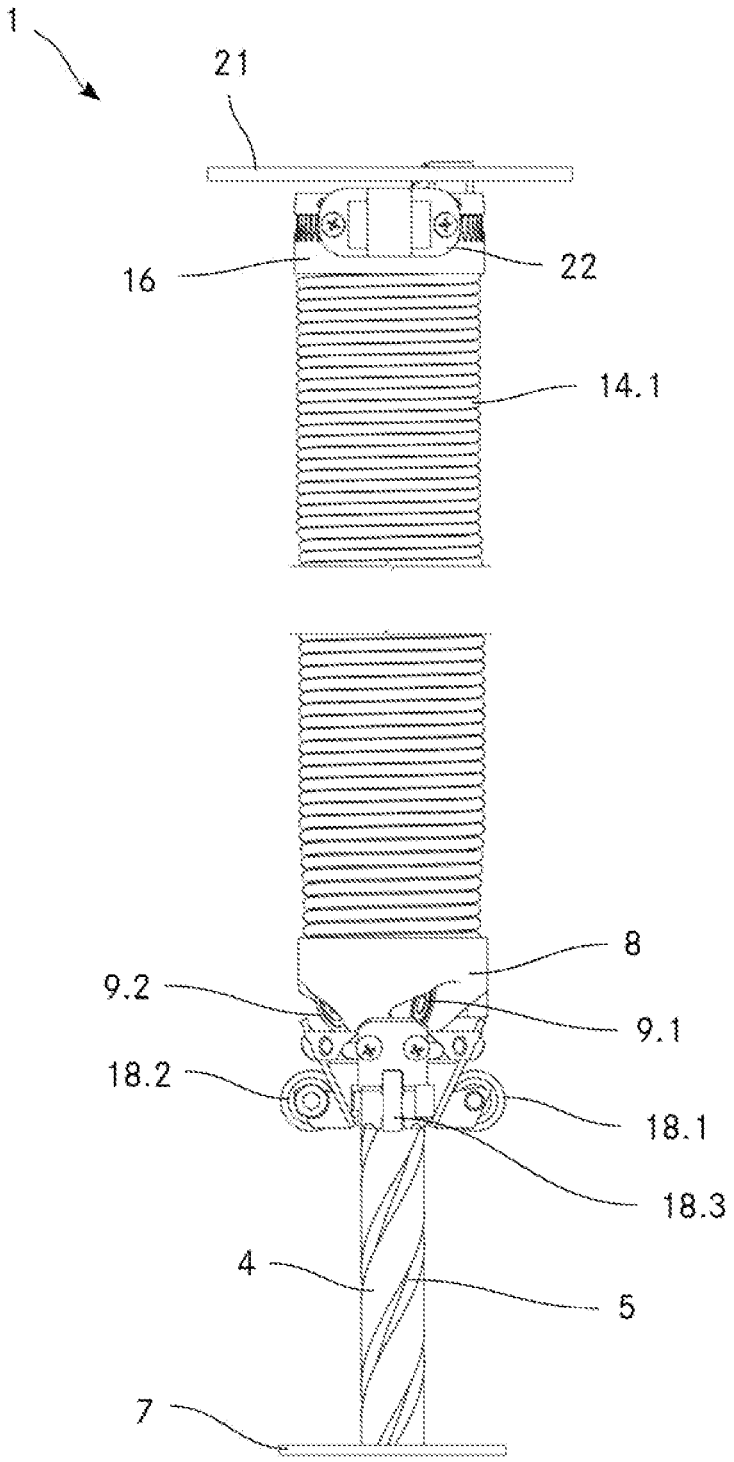
FIG. 2 shows a perspective view of the lifting column according to FIG. 1.

FIG. 2 shows a perspective view of the lifting column according to FIG. 1, wherein the first wall 6 and the second wall 7 have been omitted for illustrative reasons. This illustration dearly shows the arrangement of the three rolling bearings 18.1, 18.2, 18.3, which together with the grooves 19.1, 19.2 of the first element 2 form the linear guides. Also clear to see is the inclined arrangement of the rolling bodies 9.1, 9.2 of the rotor 8, said rolling bodies being designed in the form of cylindrical rollers and engaging in the thread helix 5 of the spindle 4.

In contrast to the sectional illustration according to FIG. 1, the perspective view according to FIG. 2 shows the worm wheel 16 to better effect. The worm 17 is retained in a rotationally fixed manner relative to the second element 3 by a holder 22.

Figure 3:
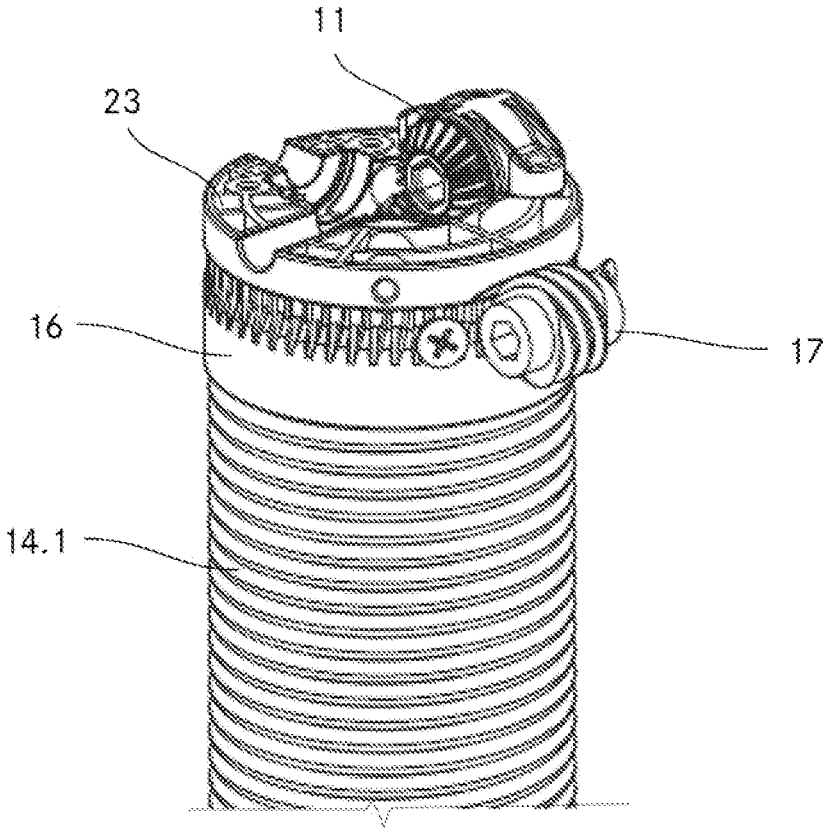
FIG. 3 shows a detail-specific view of the second end of the second element.

FIG. 3 shows a perspective, detail-specific view of the second end of the second element 3. It clearly shows the worm 17, which is in engagement with the worm wheel 16. The worm wheel 17 has a hexagon-socket drive 25. Via this hexagon-socket drive 25, the worm 17 can be made to rotate by way of a hexagon key.

The bevel wheel 11 is mounted in a rotatable manner in the cover 23 and is in engagement with the toothing formation 13 of the hollow shaft 12. The bevel wheel 11 has a central bore 26, by means of which the bevel wheel 17 can be brought into engagement with a shaft not shown).

FIGS. 4*a* and 4*b* show detail-specific views of a second embodiment of a lifting column 1 according to the invention, in the case of which the rolling bodies 9.1-9.3 are designed in the form of bails. FIG. 4*a* shows a perspective view of the spindle 4, which has three thread helixes 5.1-5.3, in which a respective rolling body 9.1-9.3 designed in the form of a ball runs. The three rolling bodies 9.1-9.3 are arranged in each case at an angle of 120° in relation to one another, which can be seen to good effect in the sectional illustration of FIG. 4*b*. The thread helixes 5.1-5.3 of the spindle 4 have a round cross section, and therefore the rolling bodies 9.1-9.3, which are designed in the form of balls, can run therein with as little play as possible.

FIGS. 5*a* and 5*b* show detail-specific views of a third embodiment of a lifting column 1 according to the invention, in the case of which the rolling bodies 9.1-9.3 are designed in the form of tapered rollers. FIG. 5*a* illustrates a perspective view of the spindle 4 with the rolling bodies 9.1-9.3, whereas FIG. 5*b* is a sectional illustration. These rolling bodies 9.1-9.3 run on the thread helixes 5.1-5.3 of the spindle 4, these thread helixes being in the form of areas on the surface of the spindle 4. Each of the rolling bodies 9.1-9.3 which are designed in the form of tapered rollers, has a pins 27.1-27.3, by way of which the rolling bodies 9.1-9.3 connected to the rotor 8.

The invention claimed is:

1. A lifting column for a piece of furniture comprising: a first element and a second element, which is introduced at least partially into the first element, wherein the first element has a spindle, which extends along the longitudinal axis of the first element and projects at least some way into the second element, and wherein the second element has a rotor, which is mounted in a rotatable manner in the second element and has at least one rolling body, which runs in or on a thread helix of the spindle, wherein a rotation of the rotor relative to the spindle gives rise to a linear movement of the second element relative to the first element, wherein the second element has an arresting device, which, in a first state, blocks the rotation of the rotor relative to the spindle and, in a second state, frees the rotation of the rotor relative to the spindle, wherein at least one leg spring is clamped in between the rotor and a fastening element, which is fastened on the second element, the at least one leg spring subjecting the rotor to a prestressing force.

2. The lifting column according to claim 1, wherein the at least one rolling body is configured in the form of at least one of a ball, cylindrical roller, tapered roller or barrel roller.

3. The lifting column according to claim 1, wherein for the purpose of setting the prestressing force of the at least one leg spring, the fastening element can be moved in the form of an arc of a circle around the longitudinal axis of the leg spring.

4. The lifting column according to claim 3, wherein the fastening element is arranged on a worm wheel, which may be rotated by means of a worm connected in a rotationally fixed manner to the second element.

5. The lifting column according to claim 1, wherein the first element and the second element have a round cross section, and wherein the second element has a smaller diameter than the first element.

6. The lifting column according to claim 1, wherein the second element is guided in a linearly movable manner within the first element by at least one linear guide.

7. The lifting column according to claim 6, wherein the second element has at least one rolling bearing, and wherein an outer ring of the rolling bearing is introduced into a groove of the first element in order to form the at least one linear guide.

8. The lifting column according to claim 1, wherein the rotor is connected to a hollow shaft which extends within the second element, coaxially in relation to the same, to a second end of the second element, this second end not being introduced into the first element, and wherein the hollow shaft has a toothing formation in the region of the second end of the second element.

9. The lifting column according to claim 1, wherein the thread helix of the spindle has a variable pitch.

10. The lifting column according to claim 1, wherein the at least one rolling body is a cylindrical roller, tapered roller or barrel roller configured in the form of a rolling bearing, and wherein an outer ring of the rolling bearing forms the cylindrical roller, tapered roller or barrel roller and runs in or on the thread helix of the spindle.

11. The lifting column according to claim 1, wherein a plurality of leg springs are clamped in in a parallel state between the rotor and fastening element.

12. A piece of furniture having at least one lifting column comprising:

a first element and a second element introduced at least partially into the first element; the second element being fastened to a furniture element;

the first element having a spindle extending along a longitudinal axis of the first element and projecting at least partially into the second element;

the second element having a rotor mounted in a rotatable manner in the second element and having at least one rolling body, which runs in or on a thread helix of the spindle;

wherein a rotation of the rotor relative to the spindle gives rise to a linear movement of the second element relative to the first element;

the second element having an arresting device, which, in a first state, blocks rotation of the rotor relative to the spindle and, in a second state, frees rotation of the rotor relative to the spindle, and at least one leg spring being clamped in between the rotor and a fastening element, which is fastened on the second element, the at least one leg spring subjecting the rotor to a prestressing force.

13. The piece of furniture according to claim 12, wherein a shaft is fitted on the furniture element, the shaft having a bevel wheel engaging with a toothing formation of a hollow shaft of the at least one lifting column in the region of the second end of the second element, the rotor being connected to the hollow shaft which extends within the second element, coaxially in relation to the same, to a second end of the second element, the second end not being introduced into the first element.

14. The piece of furniture according to claim 13, wherein the shaft is fitted on the furniture element by means of a holder, and wherein the holder has a double wrap spring brake which acts on the shaft.

15. The piece of furniture according to claim 13, wherein the fastening element is arranged on a worm wheel which may be rotated by means of a worm connected in a rotationally fixed manner to the second element, a crankshaft being fitted on the furniture element, and configured to drive the worm.

* * * * *